US006840838B1

(12) United States Patent
Reid et al.

(10) Patent No.: US 6,840,838 B1
(45) Date of Patent: Jan. 11, 2005

(54) DOLL ASSEMBLY

(76) Inventors: Shelton L. Reid, 1600 Wedgewood Dr., Apt. #110, Gurnee, IL (US) 60031; Scott Wallace, 1600 Wedgewood Dr., Apt. #110, Gurnee, IL (US) 60031

( * ) Notice: Subject to any disclaimer, the term of this patent is extended or adjusted under 35 U.S.C. 154(b) by 0 days.

(21) Appl. No.: 10/729,287

(22) Filed: Dec. 8, 2003

(51) Int. Cl.[7] ..... A63J 19/00
(52) U.S. Cl. ..... 446/331; 446/365
(58) Field of Search ..... 446/331, 361, 446/365, 97

(56) References Cited

U.S. PATENT DOCUMENTS

| | | | | | |
|---|---|---|---|---|---|
| 1,394,689 | A | | 10/1921 | De Costa | |
| 2,202,677 | A | * | 5/1940 | Stasys | 446/362 |
| 2,202,877 | A | | 5/1940 | Liarskis | |
| 2,760,303 | A | * | 8/1956 | Del Mas | 446/97 |
| 3,465,474 | A | | 9/1969 | Garrial et al. | |
| 4,411,096 | A | | 10/1983 | Smith | |
| 5,112,265 | A | | 5/1992 | Naum | |
| 388,122 | A | | 3/1996 | Nelson | |
| 6,511,359 | B1 | * | 1/2003 | Lui | 446/321 |
| D470,886 | S | * | 2/2003 | Sheng | D19/42 |
| D474,421 | S | * | 5/2003 | Weiser | D11/162 |
| 2003/0166374 | A1 | * | 9/2003 | Nelson et al. | 446/379 |

* cited by examiner

*Primary Examiner*—Derris H. Banks
*Assistant Examiner*—Ali Abdelwahed

(57) ABSTRACT

A doll assembly includes a base that has a top side. A set of legs is integrally attached to and extends upwardly from the top side. The set of legs has an upper end that is attached together. A torso section has bottom end and a top end. Each of a pair of arms is integrally attached to and extends away from the torso section. A neck is integrally attached to and extends upwardly from the top end. A first spring attaches the torso section to the set of legs such that the torso section is movable with respect to the set of legs. A head has a bottom side. A second spring attaches the neck to the head such that the head is movable with respect to the neck.

1 Claim, 3 Drawing Sheets

DOLL ASSEMBLY

BACKGROUND OF THE INVENTION

1. Field of the Invention

The present invention relates to doll devices and more particularly pertains to a new doll device that includes body parts that move and bob with respect to each other when the doll is moved.

2. Description of the Prior Art

The use of doll devices is known in the prior art. While these devices fulfill their respective, particular objectives and requirements, the need remains for a device that includes a torso section movably coupled to legs and a head that is movably coupled to the torso section so that the torso section moves with respect to both the head and the legs.

SUMMARY OF THE INVENTION

The present invention meets the needs presented above by including a torso section attached by springs to legs and a head so that the torso bobs and moves with respect the legs and the head. This action provides more of a dancing movement than simply a bobbing head as found in the prior art.

To this end, the present invention generally comprises a base that has a top side. A set of legs is integrally attached to and extends upwardly from the top side. The set of legs has an upper end that is attached together. A torso section has bottom end and a top end. Each of a pair of arms is integrally attached to and extends away from the torso section. A neck is integrally attached to and extends upwardly from the top end. A first spring attaches the torso section to the set of legs such that the torso section is movable with respect to the set of legs. A head has a bottom side. A second spring attaches the neck to the head such that the head is movable with respect to the neck.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
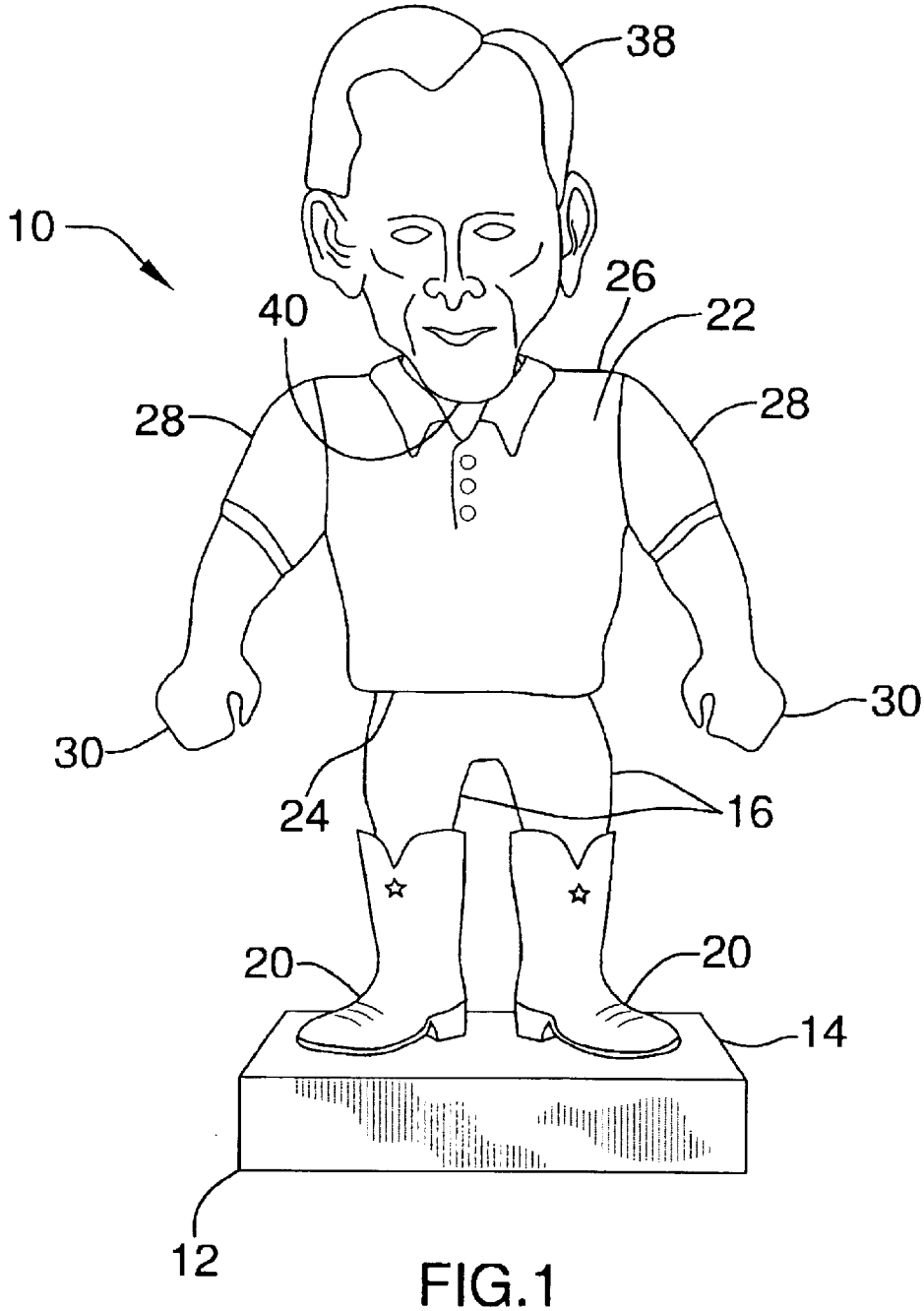
FIG. 1 is a schematic front perspective view of a doll assembly according to the present invention.
Figure 2:
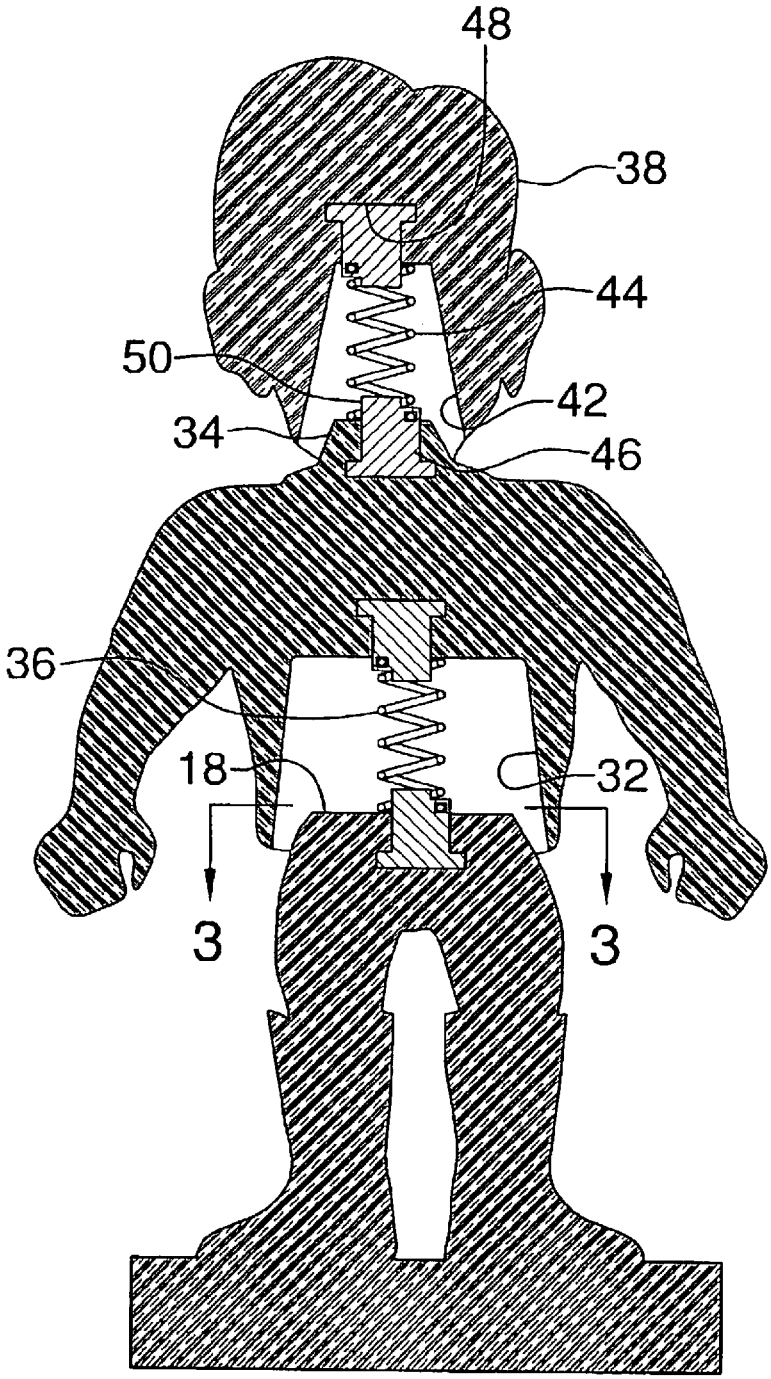
FIG. 2 is a schematic front cross-sectional view of the present invention.
Figure 3:
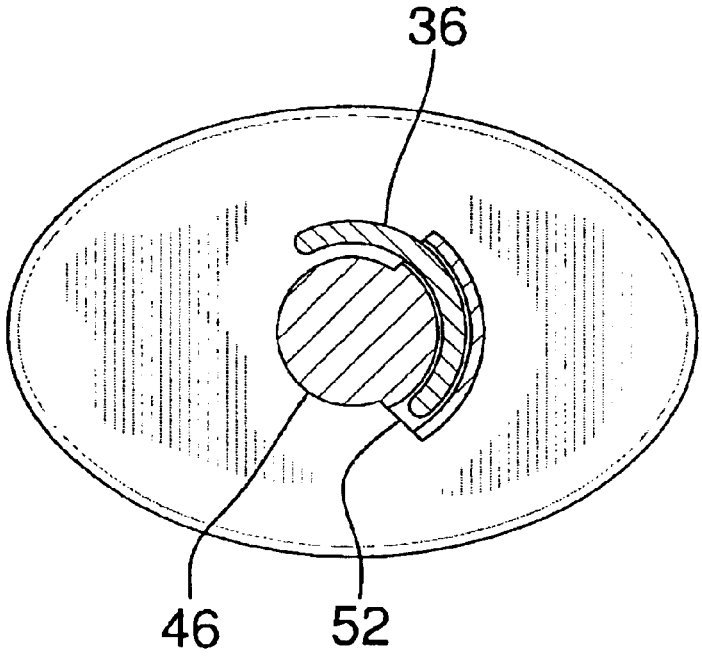
FIG. 3 is a schematic cross-sectional view of the present invention.

With reference now to the drawings, and in particular to FIGS. 1 through 3 thereof, a new doll device embodying the principles and concepts of the present invention and generally designated by the reference numeral 10 will be described.

As best illustrated in FIGS. 1 through 3, the doll assembly 10 generally comprises a base 12 that has a top side 14. A set of legs 16 is integrally attached to and extends upwardly from the top side 14. The set of legs 16 has an upper end 18 wherein each of the legs of the set is attached together. The set 16 preferably includes a pair of legs each having bottom portions 20 defining feet.

A torso section 22 has bottom end 24 and a top end 26. Each of a pair of arms 28 is integrally attached to and extends away from the torso section 22. The arms 28 preferably terminate with hands 30 being integrally attached thereto. The bottom end 24 of the torso section 22 has a well 32 extending upwardly therein. The well 32 preferably has a frusto-conical shape. A neck 34 is integrally attached to and extends upwardly from the top end 26. A first spring 36 attaches the upper end 18 of the set of legs 16 to an interior surface of the well 32 such that the upper end 18 of the set of legs 16 is positioned within the well 32. The first spring allows the torso section 22 to be movable with respect to the set of legs 16. The first spring 36 is generally vertically orientated so that the torso section 22 extends upwardly from the set of legs 16.

A head 38 has a bottom side 40. The bottom side 40 has a hole 42 extending upwardly therein. The hole 42 preferably has a frusto-conical shape. The head 38 preferably includes a face and other details so that the head appears to be the head of a person. Ideally, the head 38 is oversized with respect to the torso section 22. A second spring 44 attaches the neck 34 to an upper wall of the hole 42 such that the neck 34 extends into the hole 42 and the head 38 is movable with respect to the neck 34. The second spring 44 is generally vertically orientated for the same reason as the orientation of the first spring 36.

FIG. 3 depicts couplers 46 for attaching the springs 36, 44 to the body sections 16, 22, 38 of the doll assembly 10. The couplers 46 have first ends 48 that are extended into the body sections of the doll assembly 10 and a second end 50 having a channel 52 therein for receiving an end of the springs 36, 44. The channel 52 is arcuate so that the spring may be twisted into the channel 52. The couplers 46 offer an efficient way of attaching the springs 36, 44 to the body sections while also allowing the body sections to be replaced or changed.

In use, the doll assembly 10 is stood in an upright position. When moved, the torso 22 and head 38 move with respect to each other and with respect to the set of legs 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A doll comprising:

a base having a top side;

a set of legs being integrally attached to and extending upwardly from said top side, said set of legs having an upper end being attached together;

a torso section having a bottom end and a top end, a pair of arms being integrally attached to and extending away from said torso section, said a bottom end having a well extending upwardly therein;

a neck being integrally attached to and extending upwardly from said top end;

a first spring attaching said upper end of said set of legs to an interior surface of said well such that said upper end of said set of legs is positioned within said well and said torso section is movable with respect to said set of legs, said first spring being generally vertically orientated;

a head having a bottom side, said bottom side having a hole extending upwardly therein; and a second spring attaching said neck to an upper wall of said hole such that said neck extends into said hole and said head is movable with respect to said neck, said second spring being generally vertically orientated.

* * * * *